United States Patent [19]

Schulte

[11] Patent Number: 4,632,016

[45] Date of Patent: Dec. 30, 1986

[54] APPARATUS FOR CONTROLLING AN ADJUSTABLE ARM

[75] Inventor: Heinz Schulte, Marktheidenfeld, Fed. Rep. of Germany

[73] Assignee: Mannesmann Rexroth GmbH, Lohr, Fed. Rep. of Germany

[21] Appl. No.: 707,380

[22] Filed: Mar. 1, 1985

[30] Foreign Application Priority Data

Mar. 2, 1984 [DE] Fed. Rep. of Germany ..... 3407781

[51] Int. Cl.[4] ..... F15B 11/08

[52] U.S. Cl. ..... 91/461; 91/388

[58] Field of Search ..... 91/461, 405, 388, 403, 91/410, 469, 446

[56] References Cited

U.S. PATENT DOCUMENTS

| | | | |
|---|---|---|---|
| 4,293,040 | 10/1981 | O'Connor | 91/461 |
| 4,350,209 | 9/1982 | O'Connor | 91/461 |
| 4,510,847 | 4/1985 | Mucheyer | 91/410 |
| 4,574,687 | 3/1986 | Kauss | 91/461 |

*Primary Examiner*—Abraham Hershkovitz
*Attorney, Agent, or Firm*—Walter C. Farley

[57] ABSTRACT

A device for controlling an adjustable arm 1 has an operating circuit 10 including a movable valve 3 with two control mechanisms 11, 12 bidirectionally actuated by pressure. A control circuit to activate the movable valve is connected to a pressure source 19, to the two control mechanism 11, 12, and to an adjustable throttle 22 attached to one of the two control mechanism 12. The control circuit also includes an adjustable throttle 24, series connected adjustable throttles 27, 28 attached to the other control mechanism 11 and a fifth adjustable throttle 57. The fifth throttle is used to create an additional actual value input. An adjustable control valve 53 employs the desired and actual value inputs supplied by the adjustable throttles in various ways by interconnecting the throttles with the control devices and a pressure ratio valve 45 so that the system responds to applied force, position or both.

3 Claims, 2 Drawing Figures

APPARATUS FOR CONTROLLING AN ADJUSTABLE ARM

CROSS REFERENCE TO RELATED APPLICATION

This invention involves an improvement on the subject matter of the invention disclosed in U.S. patent application Ser. No. 347,071, U.S. Pat. No. 4,510,847, filed Feb. 8, 1982, and assigned to the owner of the present application. The content of application Ser. No. 347,071, now U.S. Pat. No. 4,510,847 is hereby incorporated by reference.

BACKGROUND OF THE INVENTION

In devices such as that shown in Ser. No. 347,071 now U.S. Pat. No. 4,510,847, piston and cylinder drive mechanism is mechanically coupled to a movable arm such as the hoisting device on a tractor or the like. A hydraulic pressure medium is supplied to the piston and cylinder assembly to cause it to move in one direction, and the piston and cylinder assembly can be vented to allow it to move in the other direction. The application of pressure or the venting of the supply conduit is controlled by the position of a multiple position valve which is acted upon by fluid pressure operated control devices. The control devices are connected to adjustable throttle valves, two of these valves being moved to define an input or reference signal and the others being moved in response to the actual position and the amount of force being applied to the adjustable arm.

Two of these adjustable throttle valves are connected consecutively, i.e., in series with the junction between them being coupled to one of the control devices. The other two are similarly connected to the other control device and also to a pressure ratio valve which is connected to this control device through an additional adjustable throttle. Because of this connection, both control mechanisms of the movable valve are influenced by each change of the adjustable throttles.

SUMMARY OF THE INVENTION

An object of the present invention is to provide an additional controlled condition sensor, i.e., a variable device which responds to the actual value or position of the arm, and to use the various input and output responsive sensors in different ways.

A further object is to provide a fifth adjustable throttle valve which constitutes a controlled or output condition sensor and which can be connected to one of the input sensors instead of another output sensor by activating or deactivating the pressure ratio valve.

In this context, it will be recognized that a controlled condition or output quantity sensor is a device which alters the cross sectional area of a flow passage in response to a change in the condition of the movable arm as it is operated on by a power device such as a piston and cylinder assembly. Furthermore, it will be recognized that a desired position or input quantity sensor is moved to a position which represents a desired response of the arm and similarly alters the cross sectional area of a flow passage.

Briefly described, the invention includes an apparatus for controlling the position of an adjustable member in response to a command or input signal and an actual value signal which includes a source of fluid under pressure and an operating circuit including a bidirectionally operable multi-way valve for controlling the flow of pressurized fluid to the adjustable member with first and second pressure responsive control devices for actuating the multi-way valve. A control fluid circuit is connected to operate the first and second control devices, the control circuit including first and second adjustable throttles connectable to the first control device, the first throttle being connected to a receiving tank and the second throttle being connected to the pressure source. Third and fourth adjustable throttles are connected in series with each other between the tank and pressure source, respectively, with the junction between those throttles being connected to the second control device. A pressure ratio valve connected to the pressure source is connectable to the second control device. The apparatus further includes a fifth adjustable throttle having one side connected to the tank and a multi-port, multiple position, main operating valve which is selectively positionable in accordance with the operational mode of the apparatus. Various ports of the main operating valve are connected to the first throttle, the first and second control devices, the fifth throttle, and the pressure ratio valve.

In a preferred embodiment of this apparatus, the main operating valve has a control lever by which the valve can be moved to any one of four positions. In a first one of those positions, the first throttle is connected in series with the second throttle and to the first control device and the pressure ratio valve is connected to the second control device. In the second position, the first and second throttles are connected in series and the first control device. In the third position, the first and second throttles are again connected in series and to the first control device and the pressure ratio valve is also connected to the first control device. In the fourth position, the second throttle is connected to the fifth throttle and to the first control device.

BRIEF DESCRIPTION OF THE DRAWING

In order to impart full understanding of the manner in which these and other objectives are attained in accordance with the invention, a particularly advantageous embodiment thereof will be described with reference to the accompanying drawing, which forms a part of this specification, and wherein.

DESCRIPTION OF THE PREFERRED EMBODIMENT

Figure 1:
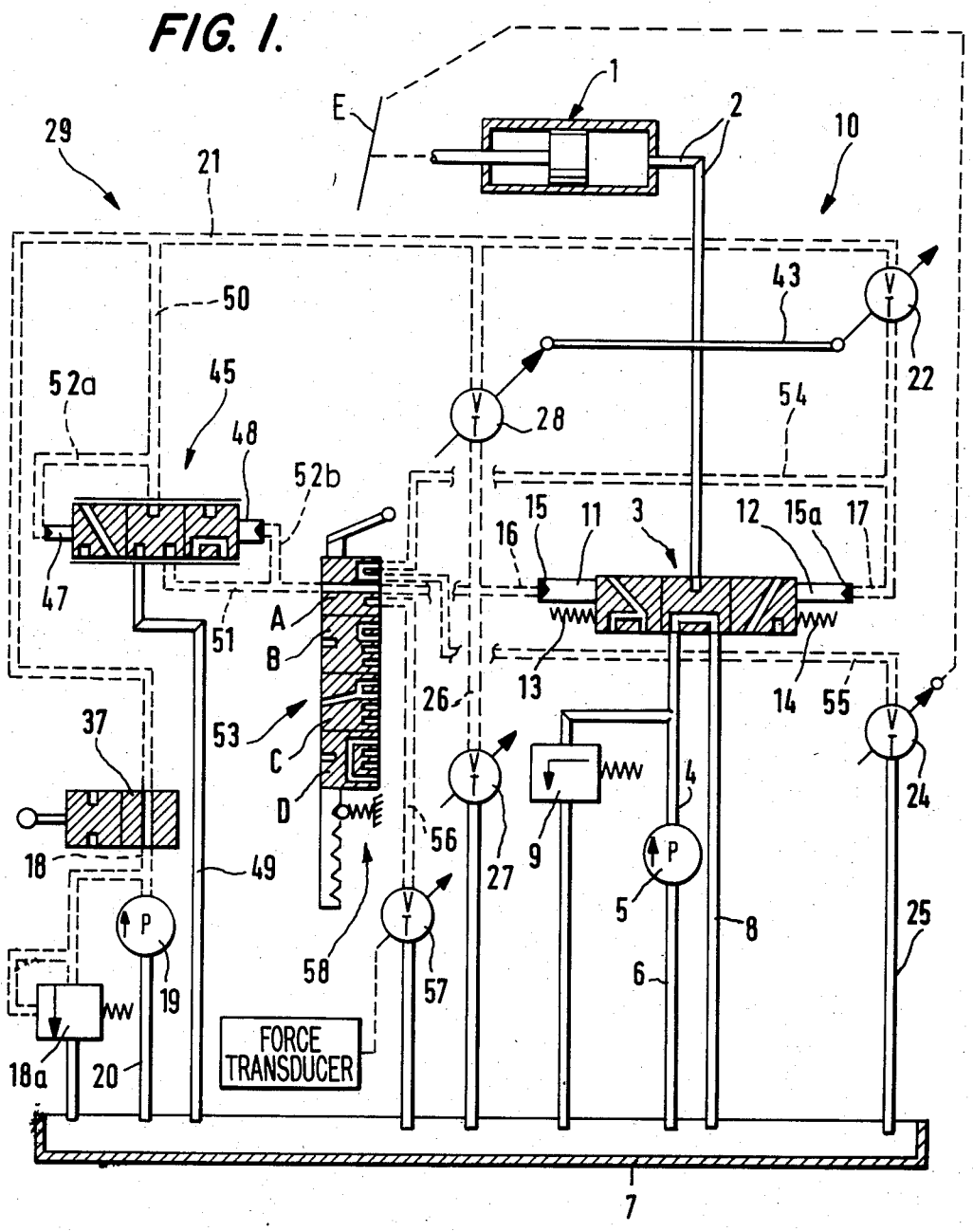
FIG. 1 is a schematic fluid circuit diagram for regulating the hoisting device of a tractor or the like in accordance with the invention.

As shown in the figure, an adjustable element identified as E is mechanically coupled to the rod of the piston in a piston and cylinder assembly indicated generally at 1. The cylinder of this assembly is connected by a conduit 2 to one port of a three-port, three-position valve indicated generally at 3 which is constructed as a proportional valve and is preferably continuously variable between the three positions. Valve 3 is actuated in both directions by means of fluid pressure acting on control devices 11 and 12. A pump 5 supplies liquid through a conduit 4 to a second port of valve 3 and draws liquid through conduit 6 from a tank or sump 7. The third port of valve 3 is an exhaust port which is connected through conduit 8 to tank 7. A pressure relief valve 9 is connected in parallel with pump 5, the outflow side of valve 9 being connected to tank 7. Components 1 through 9 can be regarded as forming an operating circuit which is indicated generally at 10.

Control devices 11 and 12 operate to push the movable slide mechanism of valve 3 in the directions of arrows 15, 15*a*, respectively, which are shown in the schematic representations of the control mechanisms, by the action of a pressure medium (liquid or gas) against the slide counter to the effect of springs 14 and 13. Springs 13, 14 attempt to maintain the slide in its central position if control mechanisms 11, 12 are not activated. A control conduit 16 is connected to deliver fluid under pressure to control device 11 and a control conduit 17 is similarly connected to control device 12.

A pump 19 supplies fluid under pressure for operating the control portions of the system, pump 19 being connected to draw fluid from tank 7 through a conduit 20. The pressure side of pump 19 is connected through a conduit 18 to a manually movable, two-position, two-port valve 37. A pressure relief valve 18*a* is connected between conduit 18 and the tank in parallel with pump 19. The other port of valve 37 is connected to a conduit 21 which is connected to one side of an adjustable throttle 22, the other side of which is connected through conduit 17 to control device 12. Two further adjustable throttles 27 and 28 are connected in series relationship with each other between conduit 21 and tank 7, the connection 26 between those throttles being connected to conduit 16 leading to control device 11. An adjustable throttle 24 is connected by a conduit 25 to tank 7, the other side of throttle 24 being connected through a conduit 55 to an adjustable main operating valve indicated generally at 53. These elements form the major components of a control circuit which is identified generally as 29.

The adjustable portions of throttles 22 and 28 are connected with each other by a rod or link 43 which mechanically assures that movement of rod 43 causes the cross sectional areas of these valves to be moved in directions contrary to each other, i.e., one is opened as the other is being closed. These throttles function as desired value sensors or signal generators and can be regarded as the control inputs. As will be described, depending upon positioning of other portions of the system, the input can either represent desired positions or desired forces. Adjustable throttles 24 and 27 constitute the actual value transmitters or output condition sensors and are connected to the movable portion of the movable element E. Thus, as element E is moved by piston and cylinder assembly 1, the adjustable components of throttles 24 and 27 are moved so that the cross sectional areas of those throttles are representative of the actual position of the movable component and of the actual force applied to the movable component, respectively. Not as schematically represented, control device 11 preferably has the same cross sectional area as control device 12 in order to achieve a balance between the pressure forces acting on the slide of valve 3 in the activated state. A pressure ratio valve 45 which is shown as a three-port, three-position proportional valve is operated by control devices 47 and 48 of which control device 47 has a smaller pressure-active surface than control device 48. Preferably, the active surface of control device 47 is half as large as the equivalent surface of control device 48. A conduit 49 connects one port of valve 45 to tank 7, a conduit 50 connects a second port of valve 45 to control conduit 21 and a conduit 51 connects the third port of valve 45 to adjustable main operating valve 53. Control device 47 is connected to conduit 50 by a conduit 52*a* and control device 48 is connected to conduit 51 by a conduit 52*b*.

Figure 2:
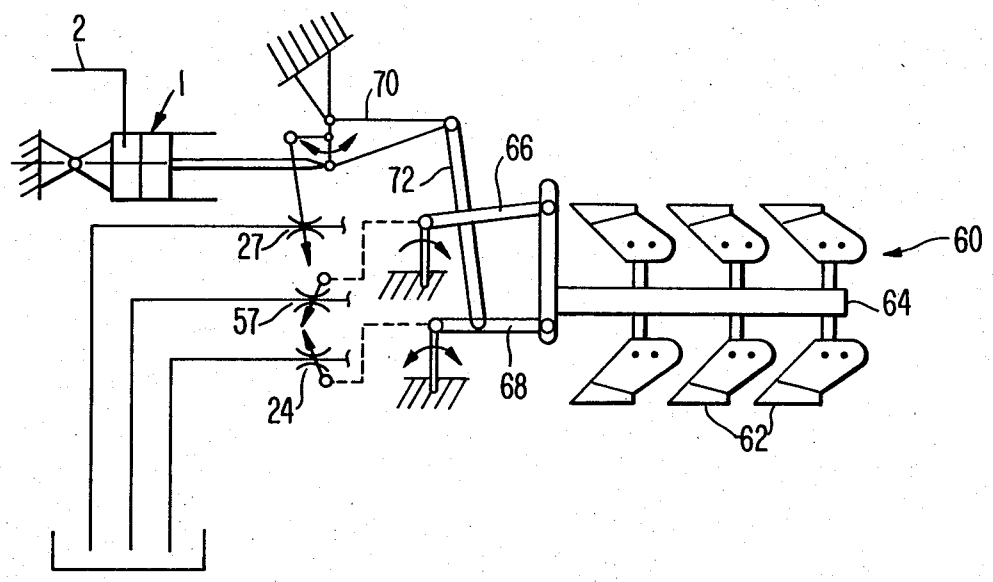
FIG. 2 is a schematic diagram showing in greater detail a hoisting device in conjunction with transducers illustrated in FIG. 1.

FIG. 2 schematically shows a plow 60 having plowshares 62 linked firmly with each other by a guidance beam 64 and attached to an upper control link 66 and a lower control link 68. The other ends of links 66 and 68 are mounted on stationary portions of the tractor. The arrangement is formed such that a link quadrilateral, resembling a parallelogram, is formed. The adjustment of throttle 57 is controlled by the upper control link and the adjustment of throttle 24 is controlled by the lower link as a function of the pull exerted on the plow.

The pressure cylinder of the controlled element indicated generally at 1 is connected to line 2. The piston rod thereof is connected to a triangular lever 70, pivotable about a fixed point, the distal end of lever 70 being articulated with a link 72 pivotally connected to lower link 68. The triangular lever 70 also controls the adjustment of throttle 27 in accordance with plow position.

The adjustable main operating valve 53 is a four-position, five-port valve which is manually movable to four distinct positions which are determined by a detent device schematically indicated at 58. In addition to the connection of conduit 51 to one port of valve 53, a conduit 54 connects a second port of the valve to control device 12 through conduit 17 and a third port is connected through conduit 55 to adjustable throttle 24. The fourth port is connected through conduit 16 to control device 11 and to the junction conduit 26 between throttles 27 and 28. Finally, the fifth port is connected through a conduit 56 to a fifth adjustable throttle 57, the other side of which is connected to tank 7.

The movement of the operating lever of valve 53 can interconnect the operating devices in any one of four combinations which correspond to positions A, B, C and D of valve 53 to establish the operating mode of the system in any of four possible categories. In position A of the lever of valve 53, the side of throttle 22 toward control device 12 is connected to throttle 24, thus effectively connecting throttles 22 and 24 in series between control conduit 21 and tank 7 with the junction between those throttles being connected to control device 12. In addition, conduit 51 of pressure ratio valve 45 is connected to control device 11 through conduit 16. In this operating mode, the position of throttle 22 represents the desired value for a certain position of movable element E which can be a rod attached to a tractor for operating a plow. At the same time, the position of throttle 28 represents the desired value of force which is to be administered to the lower end of the rod operating the plow. When valve 53 is in position A, the desired position of the rod is maintained. Because of the connection of control device 11 to pressure ratio valve 45, throttles 27 and 28 have practically no influence on the operation of the system because control mechanism 11 is affected almost entirely by pressure ratio valve 45. Thus, it can be said that the adjustment of throttles 27 and 28 is essentially compensated for by the connection of pressure ratio valve 45.

In position B of control valve 53, the pressure ratio valve is isolated from control device 11 and throttles 22 and 24 are functionally connected in series with each other and to control device 12. Thus, control device 11 is acted upon by the pressure relationship determined by the positions of throttles 27 and 28. Under these circumstances, the control mechanism operates to try to maintain the rod holding the plow in a certain position and administers a certain force on the lower portion of the rod.

When valve 53 is in position C. throttles 22 and 24 are again functionally connected in series and to control device 12, but this junction point is also connected to conduit 51 of pressure ratio valve 45. Thus, valve 45 acts on control device 12 in such a way as to reduce the influence of valves 22 and 24 essentially to nothing. In this position of the valve 53, the system maintains a predetermined force on the lower portion of the rod as determined by the setting of throttle 28.

In position D of valve 53, throttle 24 is essentially eliminated from the system and pressure ratio valve 45 is also isolated. Throttle 22 is connected in series with throttle 57 instead of throttle 24, the position of throttle 57 representing the actual value of the force acting on the upper portion of the rod. In this position of control valve 53, the system acts to hold the forces operating on the upper and lower portions of the rod essentially constant. Thus, throttle 22, which in other modes operates to provide a signal representative of a desired position value, acts in this mode as a desired value input for a certain force on the upper portion of the rod.

While one advantageous embodiment has been chosen to illustrate the invention, it will be understood by those skilled in the art that various changes and modifications can be made therein without departing from the scope of the invention as defined in the appended claims.

I claim:

1. An apparatus for controlling the position of an adjustable element and the forces applied thereto in response to command signals comprising the combination of a source of fluid under pressure and a receiving tank;

an operating circuit including a bidirectionally operable multiple position valve for controlling the flow of pressurized fluid from said source to the adjustable element and first and second pressure responsive control devices for actuating said multiple position valve;

a control fluid circuit connected to operate said first and second devices, said control circuit including first and second adjustable throttles connectable to said first control device, said first throttle being connected to said tank and said second being connected to said source, and third and fourth adjustable throttles connected in series with each other between said tank and said pressure source, respectively, with the junction between said throttles connected to said second control device;

a pressure ratio valve connected to said pressure source and being connectable to said second control device;

a fifth adjustable throttle having one side connected directly to said tank;

a multi-port, multi-position main operating valve selectively positionable in accordance with the operational mode of the apparatus; and means directly connecting different ones of the ports of said main operating valve respectively to said first throttle, said first and second control devices, the other side of said fifth throttle and said pressure ratio valve, the direct connections being constantly open for fluid flow.

2. An apparatus in accordance with claim 1 wherein said main operating valve has a control lever by which any one of four valve positions can be selected and wherein in a first of said positions said first throttle is connected in series with said second throttle and to said first control device and said pressure ratio valve is connected to said second control device;

in a second of said positions said first and second throttles are connected in series and to said first control device;

in a third of said positions said first and second throttles are connected in series with each other and to said first control device and said pressure ratio valve is also connected to said first control device; and in a fourth of said positions said second throttle is connected to said fifth throttle and to said first control device.

3. An apparatus for controlling the position of an adjustable element and the forces applied thereto in response to command signals comprising the combination of a source of fluid under pressure and a receiving tank;

positionable valve means for controlling the flow of pressurized fluid from said source to the adjustable member;

first and second pressure responsive means for actuating said positionable valve means;

a control fluid circuit connected to operate said first and second pressure responsive means, said control circuit including second and fourth adjustable throttles connected to a pressure source and mechanically adjustable to establish input values representative of desired responses of said adjustable element, first, third and fifth adjustable throttles coupled to said adjustable element such that the adjustment positions of said first, third and fifth throttles represent actual reponses of said element, a pressure ratio valve connected to said pressure source;

a five-port, four-position main operating valve selectively positionable in accordance with the operational mode of the apparatus; and conduit means forming constantly open fluid paths connecting a first port of said main operating valve jointly to said first control device and said second adjustable throttle, a second port thereof to one side of said first adjustable throttle, a third port thereof jointly to said third and fourth adjustable throttles, a fourth port thereof to one side of said fifth adjustable throttle, and a fifth port thereof to said pressure ratio valve, said main operating valve being movable to said four positions to selectively interconnect said throttles, said control means and said pressure ratio valve to control the application of fluid pressure to said adjustable element in accordance with predetermined force and position criteria to allow at determine the position of or the force being applied to said element.

* * * * *